US010635024B2

(12) United States Patent
Ishizuka et al.

(10) Patent No.: US 10,635,024 B2
(45) Date of Patent: Apr. 28, 2020

(54) DEVELOPING DEVICE AND IMAGE FORMING APPARATUS, WHEREIN THE DEVELOPING ROLLER INCLUDES A MAGNETIC POLE FORMING PART TO BE FORMED WITH A PLURALITY OF MAGNETIC POLES ALONG A CIRCUMFERENCE DIRECTION OF THE DEVELOPING ROLLER

(71) Applicant: KONICA MINOLTA, INC., Tokyo (JP)

(72) Inventors: Kazuteru Ishizuka, Saitama (JP); Hiroyuki Saito, Tokyo (JP); Shunichi Takaya, Hino (JP); Kei Okamura, Yokohama (JP); Aiko Kubota, Hino (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/197,895

(22) Filed: Nov. 21, 2018

(65) Prior Publication Data

US 2019/0163094 A1 May 30, 2019

(30) Foreign Application Priority Data

Nov. 29, 2017 (JP) ..... 2017-228784

(51) Int. Cl.
*G03G 15/09* (2006.01)
*G03G 15/08* (2006.01)

(52) U.S. Cl.
CPC ..... *G03G 15/0921* (2013.01); *G03G 15/0889* (2013.01)

(58) Field of Classification Search
CPC ..... G03G 15/0921; G03G 15/0889
See application file for complete search history.

(56) References Cited

U.S. PATENT DOCUMENTS

2013/0236216 A1* 9/2013 Innami ..... G03G 15/0921 399/277

FOREIGN PATENT DOCUMENTS

JP 2007178991 A * 7/2007
JP 2007322570 A * 12/2007
JP 2008250121 A 10/2008

* cited by examiner

*Primary Examiner* — Susan S Lee
(74) *Attorney, Agent, or Firm* — Buchanan Ingersoll & Rooney PC

(57) ABSTRACT

There is provided a developing device for developing an electrostatic latent image formed on a photoreceptor with a developer to form an image, including: a developing container that contains the developer; and a developing roller that faces the photoreceptor, is arranged adjacent to the developing container, and conveys the developer contained in the developing container to the photoreceptor, wherein the developing roller includes a magnetic pole forming part to be formed with a plurality of magnetic poles along a circumferential direction of the developing roller, at least a catch pole is formed as one of the plurality of magnetic poles, and in the catch pole, an amount of a total magnetic charge in an axial direction of the developing roller is kept constant, and a part of magnetic flux density distribution is different from another part of magnetic flux density distribution along the axial direction of the developing roller.

9 Claims, 8 Drawing Sheets

DEVELOPING DEVICE AND IMAGE FORMING APPARATUS, WHEREIN THE DEVELOPING ROLLER INCLUDES A MAGNETIC POLE FORMING PART TO BE FORMED WITH A PLURALITY OF MAGNETIC POLES ALONG A CIRCUMFERENCE DIRECTION OF THE DEVELOPING ROLLER

The entire disclosure of Japanese patent Application No. 2017-228784, filed on Nov. 29, 2017, is incorporated herein by reference in its entirety.

BACKGROUND

Technological Field

The present disclosure relates to a developing device and an image forming apparatus.

Description of the Related Art

In recent years, an electrophotographic image forming apparatus has become widespread. An electrophotographic image forming apparatus is provided with a developing device. The developing device develops an electrostatic latent image formed on a photoreceptor by supplying a developer to the photoreceptor. The developer contains a toner and a carrier. When the toner and the carrier are stirred inside the developing device, static electricity is generated, and the toner and the carrier are attracted to a developing roller. Therefore, although it is desirable that a conveyance amount of the developer is uniform along an axial direction of the developing roller, the conveyance amount can fluctuate due to various factors. Fluctuation of the conveyance amount of the developer in the axial direction of the developing roller deteriorates a printing quality. Therefore, there is proposed an image forming apparatus that offsets the fluctuation of the conveyance amount of the developer conveyed by the developing roller and uniformalize the conveyance amount of the developer, by increasing a magnetic force of a part of the developing roller (e.g., see JP 2008-250121 A).

However, in the prior art as described in JP 2008-250121 A, since a magnetic force of a part of the developing roller is increased, in the axial direction of the developing roller, an amount of a total magnetic charge including the magnetic force of the part of the developing roller and a magnetic force of another part of the developing roller is different from that of one without increasing a magnetic force of a part of the developing roller. The developing roller forms a plurality of magnetic brushes through arrangement of a plurality of different magnetic poles with different strengths along a circumferential direction, and conveys the developer to the photoreceptor. Therefore, if increasing the magnetic force of a part of the developing roller changes the amount of the total magnetic charge in the axial direction of the developing roller, density of an image formed on a sheet may be nonuniform since the conveyance amount of the developer becomes nonuniform along the axial direction of the developing roller.

SUMMARY

The present disclosure has been made in view of such circumstances, and an object is to improve nonuniformity in density of an image formed on a sheet.

To achieve the abovementioned object, according to an aspect of the present invention, there is provided a developing device for developing an electrostatic latent image formed on a photoreceptor with a developer to form an image, and the developing device reflecting one aspect of the present invention comprises: a developing container that contains the developer; and a developing roller that faces the photoreceptor, is arranged adjacent to the developing container, and conveys the developer contained in the developing container to the photoreceptor, wherein the developing roller includes a magnetic pole forming part to be formed with a plurality of magnetic poles along a circumferential direction of the developing roller, at least a catch pole is formed as one of the plurality of magnetic poles, and in the catch pole, an amount of a total magnetic charge in an axial direction of the developing roller is kept constant, and a part of magnetic flux density distribution is different from another part of magnetic flux density distribution along the axial direction of the developing roller.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

First Embodiment

Figure 1:
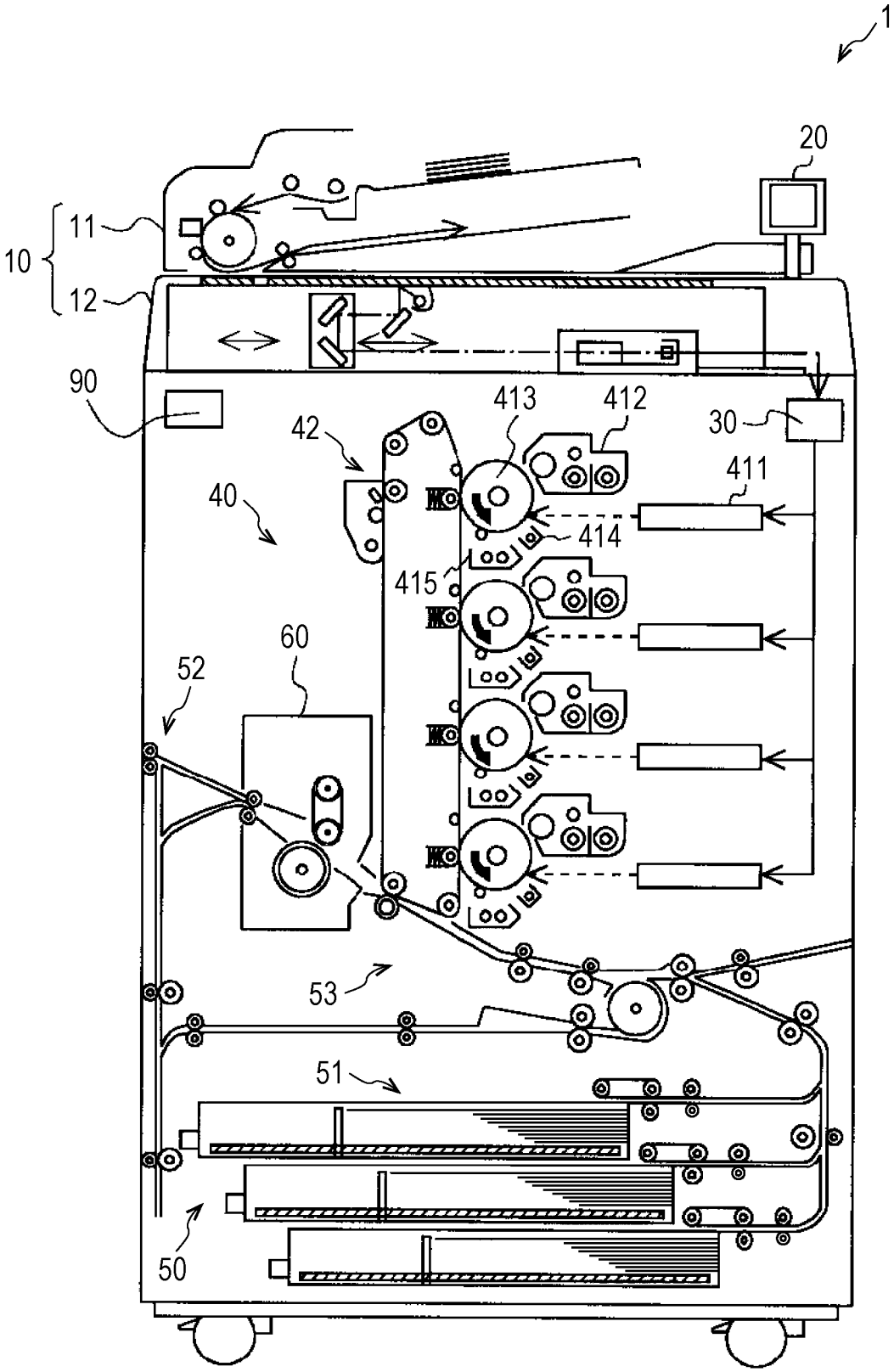
FIG. 1 is a view showing an example of an overall configuration of an image forming apparatus according to a first embodiment of the present disclosure.
Figure 2:
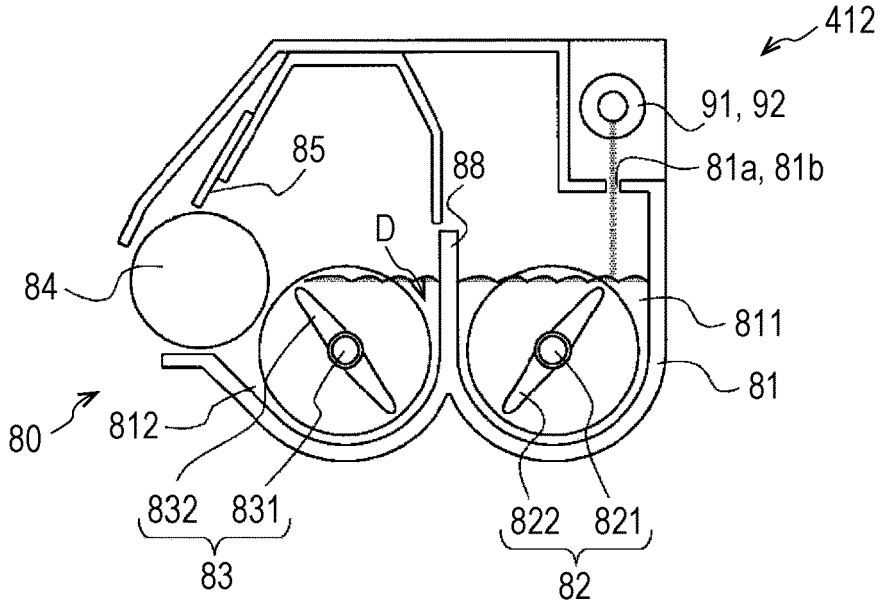
FIG. 2 is a view showing a configuration example of a developing device according to the first embodiment of the present disclosure.
Figure 3:
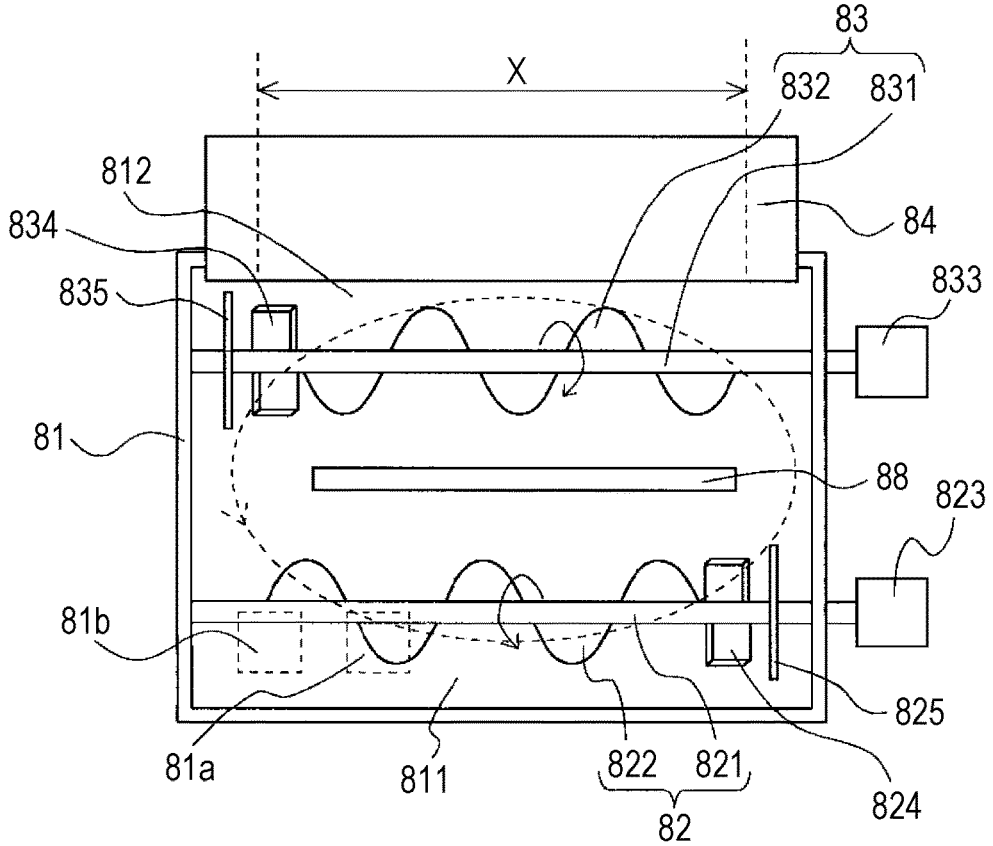
FIG. 3 is a view showing an internal configuration example of the developing device according to the first embodiment of the present disclosure.
Figure 4:
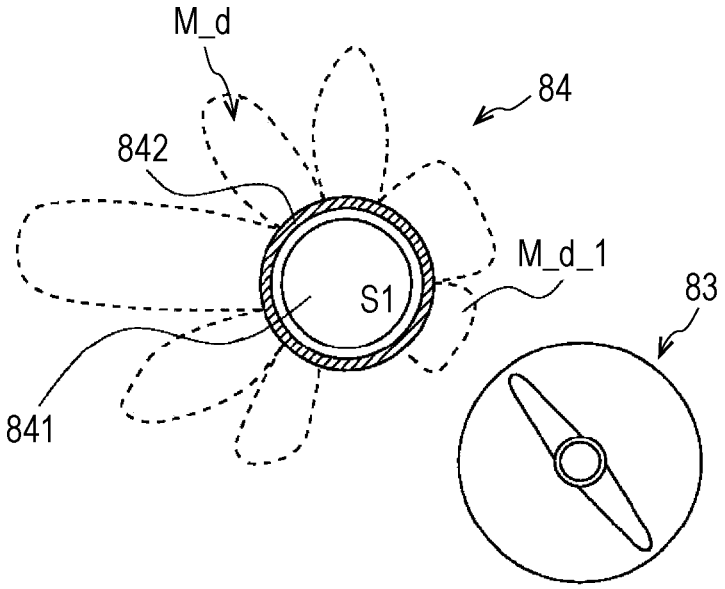
FIG. 4 is a view showing an example of a part of magnetic flux density distribution in a normal direction for each magnetic pole along a circumferential direction of a developing roller according to the first embodiment of the present disclosure.
Figure 5:
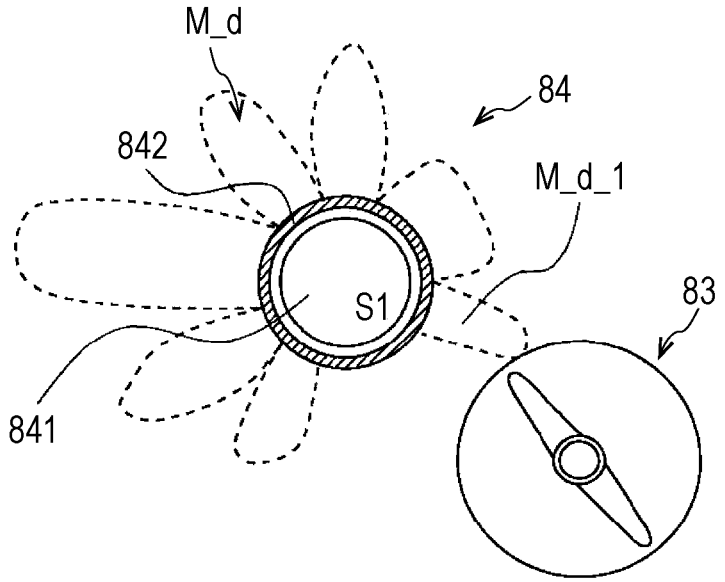
FIG. 5 is a view showing an example of another part of magnetic flux density distribution in a normal direction for each magnetic pole along a circumferential direction of the developing roller according to the first embodiment of the present disclosure.
Figure 6:
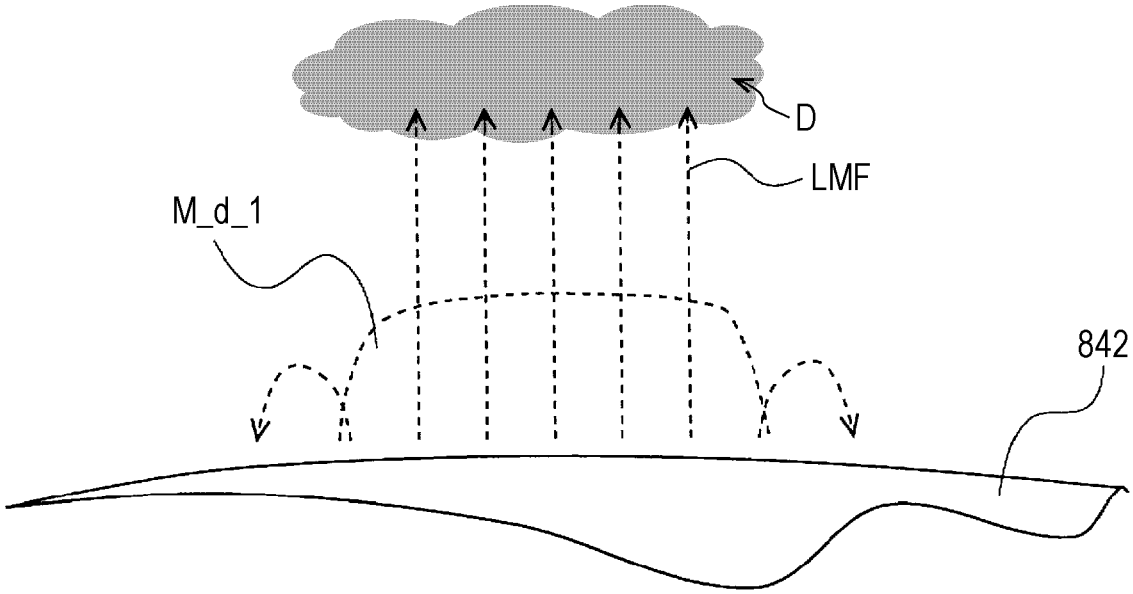
FIG. 6 is a view showing an example of the number of magnetic force lines of a part of magnetic flux density distribution of a catch pole, in magnetic flux density distribution in a normal direction for each magnetic pole along a circumferential direction of the developing roller according to the first embodiment of the present disclosure.
Figure 7:
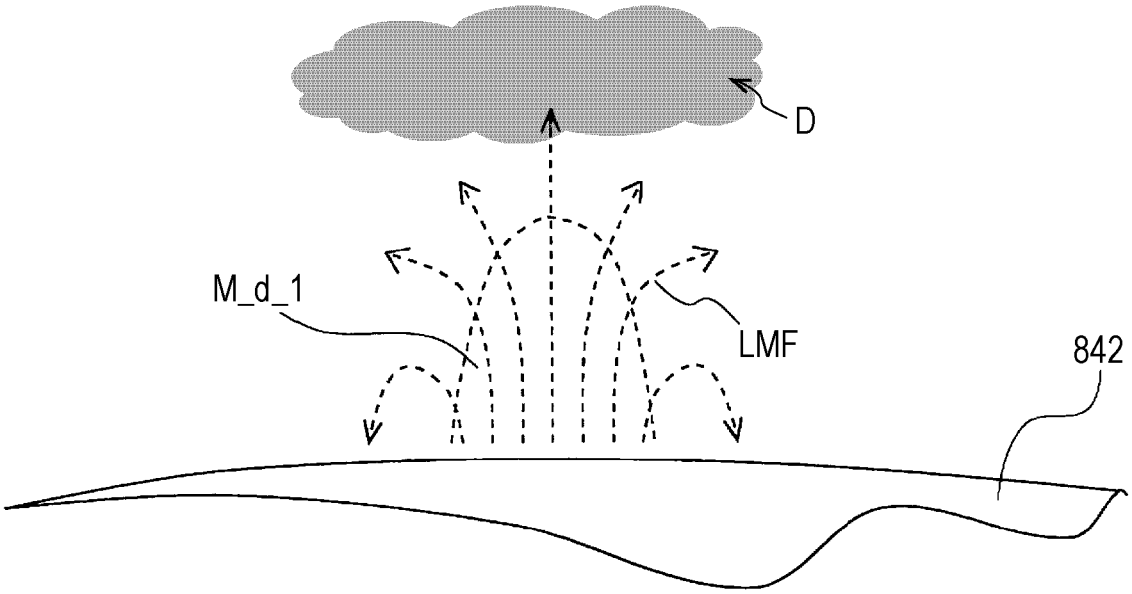
FIG. 7 is a view showing an example of the number of magnetic force lines of another part of magnetic flux density distribution of the catch pole, in magnetic flux density distribution in a normal direction for each magnetic pole along a circumferential direction of the developing roller according to the first embodiment of the present disclosure.

FIG. 1 is a view showing an example of an overall configuration of an image forming apparatus 1 according to a first embodiment of the present disclosure. FIG. 2 is a view showing a configuration example of a developing device 412 according to the first embodiment of the present disclosure. FIG. 3 is a view showing an internal configuration example of the developing device 412 according to the first embodiment of the present disclosure. FIG. 4 is a view showing an example of a part of magnetic flux density distribution M_d_1 in a normal direction for each magnetic pole along a circumferential direction of a developing roller 84 according to the first embodiment of the present disclosure. FIG. 5 is a view showing an example of another part of magnetic flux density distribution M_d_1 in a normal direction for each magnetic pole along a circumferential direction of the developing roller 84 according to the first embodiment of the present disclosure. FIG. 6 is a view showing an example of the number of magnetic force lines LMF of a part of magnetic flux density distribution M_d_1 of a catch pole S1 in magnetic flux density distribution M_d in a normal direction for each magnetic pole, along a circumferential direction of the developing roller 84 according to the first embodiment of the present disclosure. FIG. 7 is a view showing an example of the number of magnetic force lines LMF of another part of magnetic flux density distribution M_d_1 of the catch pole S1 in magnetic flux density distribution M_d in a normal direction for each magnetic pole, along a circumferential direction of the developing roller 84 according to the first embodiment of the present disclosure.

The image forming apparatus 1 forms a color image on a sheet by an intermediate transfer method using an electrophotographic process technology. The image forming apparatus 1 primarily transfers each of color toner images of yellow (Y), magenta (M), cyan (C), and black (K) formed on a photoreceptor 413 to an intermediate transfer belt of an intermediate transfer part 42. The respective color toner images primarily transferred to the intermediate transfer belt are secondarily transferred to a sheet after the four colors are superimposed, and an image is formed on the sheet. The image forming apparatus 1 adopts a tandem system. In the tandem system, the photoreceptors 413 corresponding to the four colors Y, M, C, and K described above are arranged in series in a traveling direction of the intermediate transfer belt, and toner images of respective colors are sequentially transferred onto the intermediate transfer belt in a single procedure.

The image forming apparatus 1 includes an image reading part 10, an operation display part 20, an image processing part 30, an image forming part 40, a sheet conveying part 50, a fixing part 60, and a control part 90. The control part 90 includes a CPU, a ROM, a RAM, a storage part (not shown), and the like. The CPU reads a program from the ROM in accordance with processing contents, develops the program in the RAM, and cooperates with the developed program to control operation of the image forming apparatus 1. The storage part is realized by a non-volatile semiconductor memory such as a flash memory, for example, or a hard disk drive, and stores various data. The various data stored in the storage part is referred to when the CPU controls the operation of the image forming apparatus 1.

The image reading part 10 includes an automatic document feeding device 11, a document image scanning device 12, and the like. The automatic document feeding device 11 is referred to as an auto document feeder (ADF). The automatic document feeding device 11 conveys a document placed on a document tray by a conveyance mechanism, and sends the document to the document image scanning device 12. The automatic document feeding device 11 can continuously read images of a large number of documents placed on the document tray. In continuously reading images of a large number of documents, the automatic document feeding device 11 can read both sides of each document by a sheet reversing mechanism. The document image scanning device 12 optically scans a document conveyed onto a contact glass from the automatic document feeding device 11 or a document placed on the contact glass. The document image scanning device 12 reads a document image formed on a document by forming reflected light from the document by optical scanning, on a light receiving surface of a CCD sensor. The image reading part 10 generates input image data of the document image based on a reading result of the document image scanning device 12. The input image data is supplied to the image processing part 30, and the image processing part 30 executes preset image processing.

The image processing part 30 includes a circuit that performs, on input image data, digital image processing corresponding to various profiles set by initial setting, user setting, or the like. The image processing part 30 performs various types of correction processing including gradation correction, color correction, and shading correction, for example, and compression processing and the like, oil input image data. Based on the input image data subjected to such various types of digital image processing, the image forming part 40 performs various types of processing. Based on the input image data, the image forming part 40 forms images of the respective color toners of Y component, M component, C component, and K component.

The image forming part 40 includes an exposure device 411, the developing device 412, the photoreceptor 413, a charging device 414, a drum cleaning device 415, and the like. Corona discharge of the charging device 414, causes the photoreceptor 413 to be charged. The exposure device 411 irradiates the photoreceptor 413 with laser light corresponding to the image of each color component, whereby an electrostatic latent image of each color component is formed. The developing device 412 causes toner of each color component to adhere to a surface of the photoreceptor 413, whereby the electrostatic latent image is visualized, and a toner image is formed.

The drum cleaning device 415 removes transfer residual toner remaining on the surface of the photoreceptor 413 after the primary transfer. The intermediate transfer part 42 includes an intermediate transfer belt, a primary transfer roller, a secondary transfer roller, and the like. A primary transfer nip formed by pressure contact between the intermediate transfer belt and the primary transfer roller transfers the toner image from the photoreceptor 413 to the intermediate transfer belt. A secondary transfer nip formed by pressure contact of the intermediate transfer belt and the secondary transfer roller transfers the toner image from the intermediate transfer belt to a sheet. The fixing part 60 heats and pressurizes the toner image transferred onto the sheet, to form an image on the sheet. The sheet conveying part 50 includes a sheet feeding part 51, a sheet discharging part 52, a conveying path part 53, and the like.

As shown in FIG. 2, the developing device 412 includes a developing device main body 80, a toner supply part 91, and a carrier supply part 92. The toner supply part 91 supplies toner to the developing device main body 80. The carrier supply part 92 supplies a carrier to the developing device main body 80. The developing device 412 adopts a trickle development system in which the toner consumed in image formation is supplied, and the carrier in the developing container 81 is replaced little by little. For a trickle mechanism included in the trickle development system, a publicly known circulating overflow type or liquid overflow type may be applied. Since a deteriorated carrier is replaced with a new carrier by the trickle mechanism, the toner in the developing container 81 is always uniformly charged. Therefore, stable image quality can be realized without being affected by the number of prints or environmental changes.

The developing device main body 80 includes the developing container 81, a stirring screw 82, a supply screw 83, the developing roller 84, a regulating member 85, and various types of sensors (not shown) such as a toner density sensor and a carrier detection sensor. The developing device 412 contains a two component developer D including the toner and the carrier, inside of the developing container 81 is partitioned into a stirring path 811 and a supply path 812 by a partition wall 88. The stirring path 811 and the supply path 812 extend parallel to an axial direction of the developing roller 84. The stirring path 811 and the supply path 812 communicate with each other at both axial ends of the developing roller 84 such that the developer D is circulated and conveyed. That is, a conveying direction of the developer D in the stirring path 811 is opposite to a conveying direction of the developer D in the supply path 812. The developing container 81 is provided with a toner supply port 81*a* and a carrier supply port 81*b* above the stirring path 811. The toner supply port 81*a* supplies the toner to the stirring path 811. The carrier supply port 81*b* supplies the carrier to the stirring path 811. In the example of FIG. 3, the carrier supply port 81*b* is disposed on the upstream side along a conveying direction of the developer D with respect to the toner supply port 81*a*. The to delivered from the toner supply part 91 is supplied to the developing device main body 80 via the toner supply port 81*a*. The carrier delivered from the carrier supply part 92 is supplied to the developing device main body 80 via the carrier supply port 81*b*. The toner supply operation by the toner supply part 91 and the carrier supply operation by the carrier supply part 92 are controlled by the control part 90.

In the stirring path 811, the stirring screw 82 is disposed along the axial direction of the developing roller 84. The stirring screw 82 has a configuration in which a blade 822 is spirally formed at a constant pitch over substantially the entire length of a shaft center 821 connected to a driving motor 823. The stirring screw 82 stirs the developer D. More specifically, as the stirring screw 82 rotates, the developer D is conveyed in one direction while being stirred, from the left to the right in FIG. 3. In the supply path 812, the supply screw 83 is disposed along the axial direction of the developing roller 84. The supply screw 83 has the same configuration as the stirring screw 82. That is, the supply screw 83 has a configuration in which a blade 832 is spirally formed at a constant pitch over substantially the entire length of a shaft center 831 connected to a driving motor 833. The supply screw 83 is provided between the developing roller 84 and the stirring screw 82, and supplies the developer D stirred by the stirring screw 82 to the developing roller 84. Specifically, as the supply screw 83 rotates, the toner and the carrier are conveyed in one direction while being stirred, from the right to the left in FIG. 3.

When the developer D is conveyed in the stirring path 811 and the supply path 812, the toner and the carrier contained in the developer D are in frictional contact and are charged to opposite polarities. Here, it is assumed that the carrier is charged to positive polarity and the toner is charged to negative polarity. The negatively charged toner adheres to a periphery of the positively charged carrier, mainly due to an electric attraction force between the both. The developer D is supplied to the developing roller 84 in a process of being conveyed through the supply path 812. A fin 834 is provided at one end of the shaft center 831 and moves the developer D from the supply path 812 to the stirring path 811. A fin 824 is provided at one end of the shaft center 821 and moves the developer D from the stirring path 811 to the supply path 812. A disk 835 is provided between the fin 834 and a wall surface side of the developing container 81 at one end of the shaft center 831, and suppresses movement of the developer D around the fin 834 toward the wall surface side of the developing container 81. A disk 825 is provided between the fin 824 and a wall surface side of the developing container 81 at one end of the shaft center 821, and suppresses movement of the developer D around the fin 824 toward the wall surface side of the developing container 81.

The developing roller 84 supplies the developer D to the photoreceptor 413 formed with the electrostatic latent image. Above the developing roller 84, the regulating member 85 is disposed so as to face the developing roller 84 while being spaced apart from the developing roller 84 by a certain distance. The regulating member 85 extends in parallel with the developing roller 84, and is a plate-like member formed of a magnetic material such as stainless steel, for example. As shown in FIGS. 4 and 5, the developing roller 84 includes a magnetic pole forming part 841 and a sleeve 842. In the developing roller 84, a plurality of magnetic poles is formed along a circumferential direction of the developing roller 84, and adjacent magnetic poles have polarities opposite to each other. The magnetic pole forming part 841 is arranged and fixed unrotatably, and at least the catch pole S1 is formed as one of a plurality of magnetic poles. In the catch pole S1, an amount of a total magnetic charge in the axial direction of the developing roller 84 is kept constant. In the catch pole S1, a part of the magnetic flux density distribution M_d_1 is different from another part of the magnetic flux density distribution M_d_1, in the magnetic flux density distribution M_d that appears along the axial direction of the developing roller 84. In the examples of FIGS. 4 and 5, the developing roller 84 is formed with seven magnetic poles including the catch pole S1, by the magnetic pole forming part 841. The seven magnetic poles may function as any one of a conveyance pole, a regulation pole, a development pole, and a peeling pole except for the catch pole S1, and the plurality of magnetic poles may have a same function.

The sleeve 842 is rotatably disposed around the magnetic pole forming part 841, and is formed in a cylindrical shape. In a developer region X of an outer peripheral surface of the sleeve 842, there are formed the magnetic force lines LMF that are to convey the developer D by a plurality of magnetic poles formed in the magnetic pole forming part 841 as shown in FIGS. 6 and 7. Further, as shown in FIGS. 6 and 7, in a part of the magnetic flux density distributions M_d_1, since the number of the magnetic force lines LMF in an area that becomes a magnetic force peak is larger than that of another part of the magnetic flux density distribution M_d_1, and a position of the magnetic force peak is lower than that of the another part of the magnetic flux density distribution M_d_1, the number of the magnetic force lines LMF toward the developer D increases.

Therefore, the developer D supplied to the sleeve 842 forms a magnetic brush by spiking out along time magnetic force lines LMF formed by the magnetic pole forming part 841. The developer D is conveyed counterclockwise with rotation of the sleeve 842 and is regulated to have a uniform thickness by passing through a gap between the regulating member 85 and the sleeve 842. The toner carried on the sleeve 842 is supplied to the photoreceptor 413, whereby the electrostatic latent image on the photoreceptor 413 is developed. That is, the magnetic pole forming part 841 causes the catch pole S1 to adsorb the magnetic carrier in the developer D supplied by the supply screw 83. As the catch pole S1 adsorbs the carrier, the developer D is adsorbed onto the outer peripheral surface of the sleeve 842. Since adjacent magnetic poles formed on the developing roller 84 have polarities opposite to each other, the developer D adsorbed by the catch pole S1 is conveyed as a magnetic brush, and a developing bias is applied to the magnetic pole facing the photoreceptor 413, whereby the toner in the magnetic brush is electrostatically adsorbed to time photoreceptor 413 side.

From the above description, according to the present embodiment, the catch pole S1 keeps the amount of time total magnetic charge in the axial direction of the developing roller 84 constant, and a part of the magnetic flux density distribution M_d_1 is different from another part of the magnetic flux density distribution M_d_1 along the axial direction of the developing roller 84. In a part of the magnetic flux density distributions M_d_1, the number of the magnetic force lines LMF in an area that becomes a magnetic force peak is larger than that of another part of the magnetic flux density distribution M_d_1. Therefore, in an area where a part of the magnetic flux density distribution M_d_1 appears in the axial direction of the developing roller 84, the amount of the developer D that can be conveyed to the photoreceptor 413 can be increased, but the amount of the total magnetic charge in the axial direction of the developing roller 84 is kept constant. Therefore, it is possible to improve the nonuniformity of the density A of an image formed on a sheet even if the conveyance amount of the developer D fluctuates due to various factors, since the amount of the total magnetic charge in the axial direction of the developing roller 84 is constant and the amount of the developer D in an area where a part of the magnetic flux density distribution M_d_1 appears can be increased.

Further, according to the present embodiment, in the magnetic flux density distribution M_d_1, a position of the magnetic force peak is lower than that of another part of the magnetic flux density distribution M_d_1. This enables an increase in the number of the magnetic force lines LMF toward the developer D. Therefore, even if the amount of the total magnetic charge in the axial direction of the developing roller 84 is constant, the developer D can be easily attracted to the developing roller 84.

Second Embodiment

In a second embodiment, the same components as those of the fast embodiment are denoted by the same reference numerals, and description thereof is omitted. The second embodiment is different in that two circulation paths are formed, from the first embodiment with one circulation path. Therefore, in the second embodiment, a configuration in which the two circulation paths are formed will be specifically described.

Figure 8:
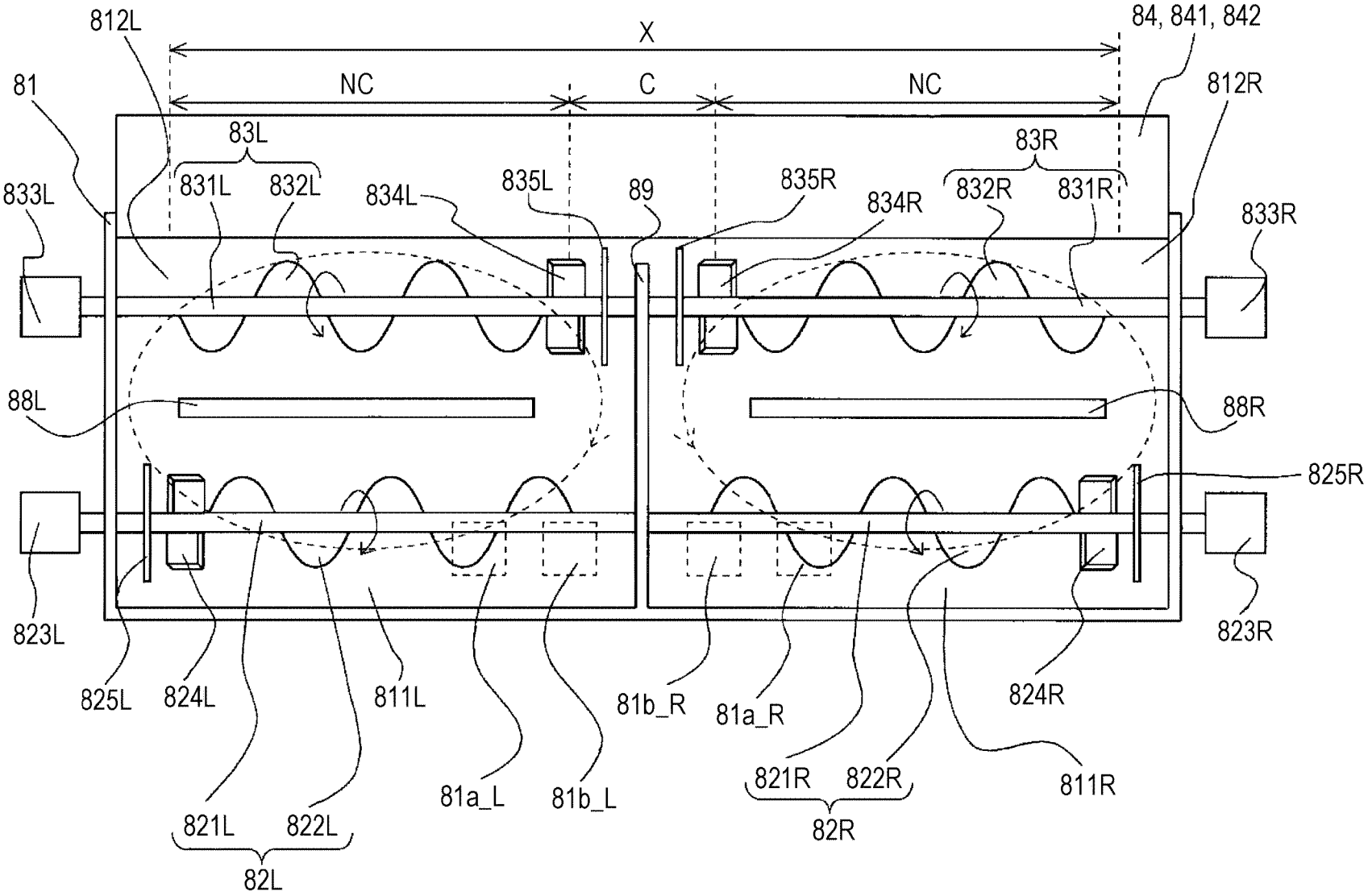
FIG. 8 is a view showing an example in which a developing container according to a second embodiment of the present disclosure includes a partition plate.

FIG. 8 is a view showing an example in which a developing container 81 according to the second embodiment of the present disclosure includes a partition plate 89. The developing container 81 is formed with a first circulation path and a second circulation path. The second circulation path is adjacent to the first circulation path along an axial direction of a developing roller 84. In the developing container 81, a stirring screw 82R and a supply screw 83R are provided in the first circulation path, and a stirring path 811R and a supply path 812R are formed. In the developing container 81, a stirring screw 82L and a supply screw 83L are provided in the second circulation path, and a stirring path 811L and a supply path 812L are formed. Since the stirring path 811R and the stirring path 811L have the same configuration as the stirring path 811; the supply path 812R and the supply path 812L have the same configuration as the supply path 812; the stirring screw 82R and the stirring screw 82L, have the same configuration as the stirring screw 82; and the supply screw 83R and the supply screw 83L have the same configuration as the supply screw 83, the description thereof will be omitted. That is, shaft centers 821R and 821L have the same configuration as the shaft center 821. Blades 822R and 822L have the same configuration as the blade 822. Driving motors 823R and 823L have the same configuration as the driving motor 823. Fins 824R and 824L have the same configuration as the fin 824. Disks 825R and 825L have the same configuration as the disk 825. Shaft centers 831R and 831L have the same configuration as the shaft center 831. Blades 832R and 832L have the same configuration as the blade 832. Driving motors 833R and 833L have the same configuration as the driving motor 833. Fins 834R and 834L have the same configuration as the fin 834. Disks 835R and 835L have the same configuration as the disk 835. Partition walls 88R and 88L, have the same configuration as the partition wall 88.

A magnetic pole forming pail 841 includes a central part C and a non-central part NC along the axial direction of the developing roller 84. The central part C faces a region that is a boundary between the first circulation path and the second circulation path. The non-central part NC is adjacent to the central part C. Apart of magnetic flux density distribution M_d_1 is to be formed to appear from the central part C. Another part of magnetic flux density distribution M_d_1 is to be formed to appear from the non-central part NC. The magnetic flux density in the central part C is stronger than the magnetic flux density in the non-central part NC. Further, the developing container 81 is provided with the partition plate 89. The partition plate 89 faces the central part C and is provided at a boundary between the supply screw 83R and the supply screw 83L, and between the stirring screw 82R and the stirring screw 82L. The disk 825R is provided on a side closer to the partition plate 89 among ends of the supply screw 83R, and suppresses at least a part of the developer D from approaching the partition plate 89. The disk 825L, is provided on a side closer to the partition plate 89 among ends of the supply screw 83L, and suppresses at least a part of the developer D from approaching the partition plate 89. The central part C of the developing roller 84 is provided in a range wider than a width between the disk 825R and the disk 825L, along the axial direction of the developing roller 84.

Figure 9:
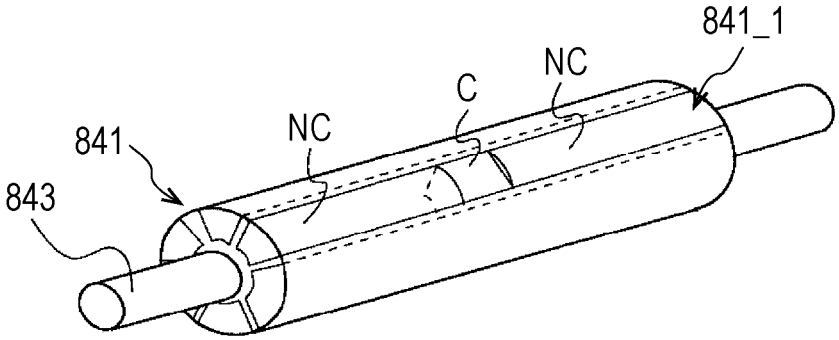
FIG. 9 is a view showing a configuration example in which a circular arc of a central part is cut as a magnetic pole forming part according to the second embodiment of the present disclosure.

FIG. 9 is a view showing a configuration example in which a circular arc of the central part C is cut as the magnetic pole forming part 841 according to the second embodiment of the present disclosure. In the example of FIG. 9, a catch pole S1 is formed by a piece 841_1 incorporated in the magnetic pole forming part 841 having a shaft center 843. The piece 841_1 is individually magnetized and already functions as a magnet. In the piece 841_1, a circular arc of the central part C is cut and an outer peripheral surface is processed to be flat. The central part C is magnetized with a higher magnetic force in a state before cutting of the circular arc, so that an amount of the total magnetic charge of the catch pole S1 becomes equal to that of the amount of the total magnetic charge expected in advance, after cutting of the circular arc.

Figure 10:
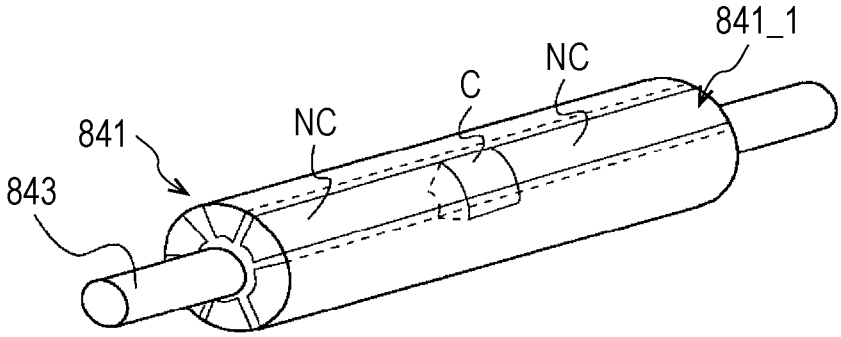
FIG. 10 is a view showing a configuration example in which a central angle of a circular arc of the central part is expanded as the magnetic pole forming part according to the second embodiment of the present disclosure.

FIG. 10 is a view showing a configuration example in which a central angle of the circular arc of the central part C is expanded as the magnetic pole forming part 841 according to the second embodiment of the present disclosure. In the example of FIG. 10, the catch pole S1 is formed by the piece 841_1 incorporated in the magnetic pole forming part 841 having the shaft center 843. The piece 841_1 may be individually magnetized, but may also be subjected to assembly magnetization that magnetizes after combination. The central part C makes the magnetic force weak and spreads the angle to the peeling pole side. Since the assembly magnetization changes a distance by normal magnetization along the axial direction of the developing roller 84, the amount of the total magnetic charge is the same while the magnetic force peak becomes low.

Figure 11:
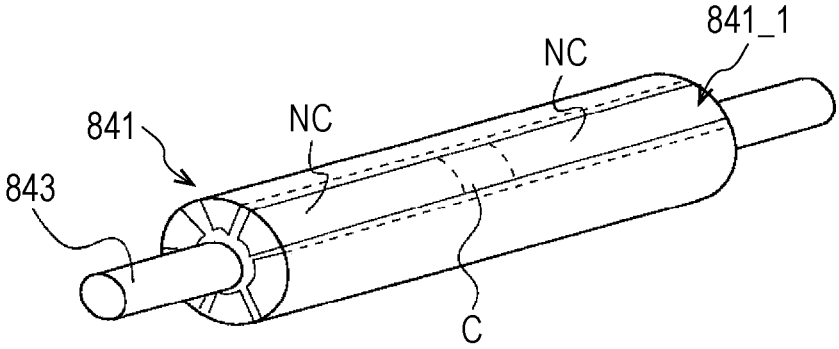
FIG. 11 is a view showing a configuration example in which a proximity distance between magnetized poles of the central part is increased as the magnetic pole forming part according to the second embodiment of the present disclosure.

FIG. 11 is a view showing a configuration example in which a proximity distance between magnetized poles of the central part C is increased as the magnetic pole forming part 841 according to the second embodiment of the present disclosure. In the example of FIG. 11, the catch pole S1 is formed by the piece 841_1 incorporated in the magnetic pole forming part 841 having the shaft center 843. In the piece 841_1, a position of the magnetic force peak is lowered by separating the proximity distance between the magnetized poles in the central part C.

Figure 12:
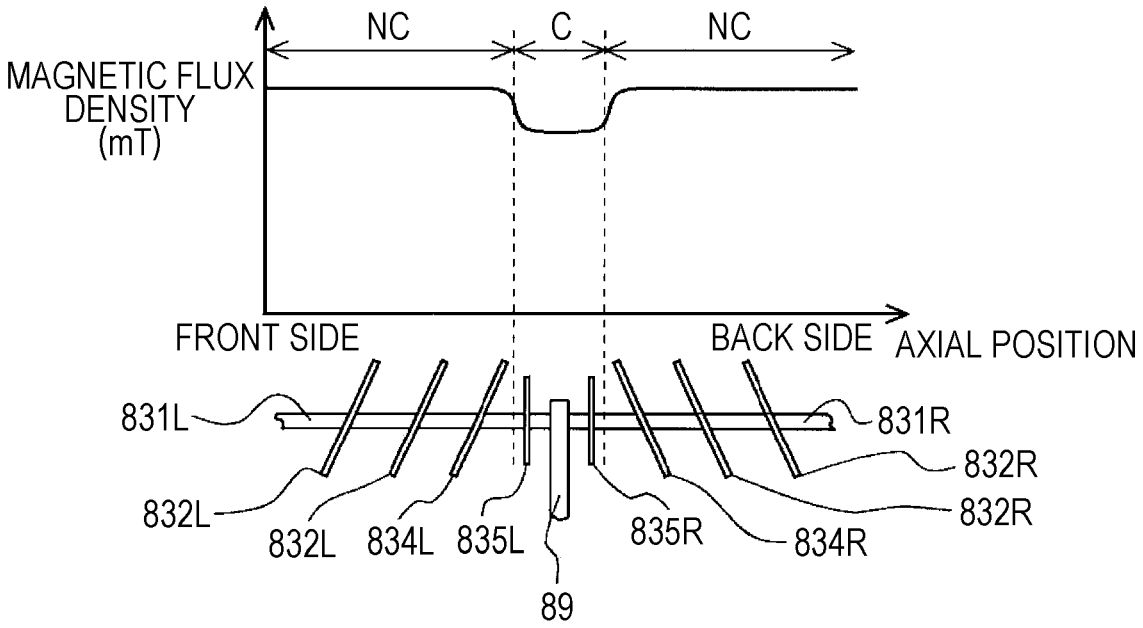
FIG. 12 is a view showing an example of magnetic flux density distribution of a piece along an axial direction of a developing roller according to the second embodiment of the present disclosure.
Figure 13:
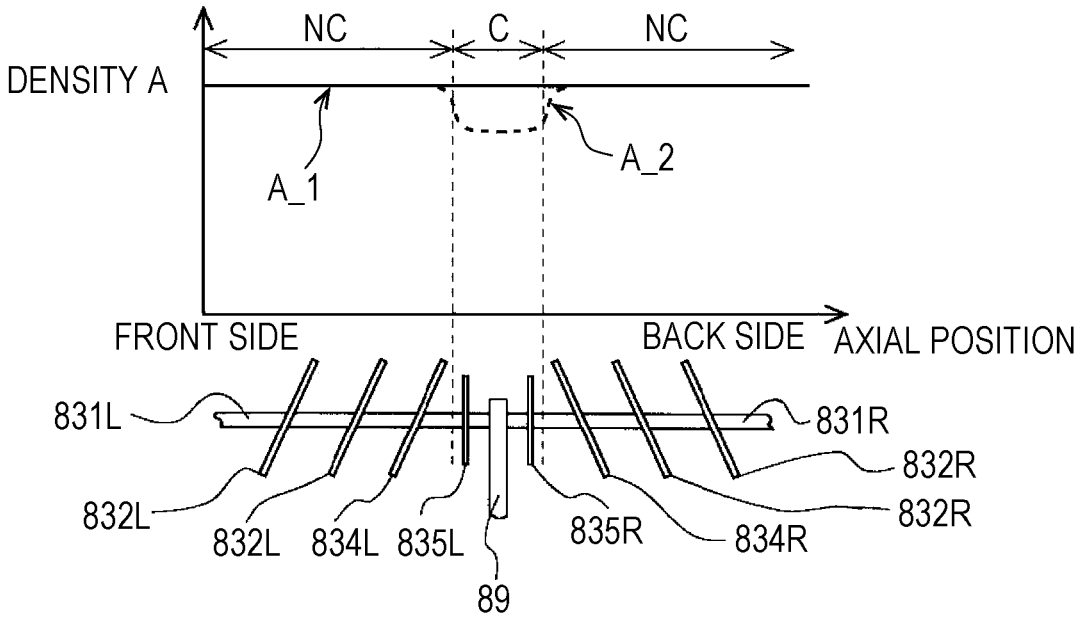
FIG. 13 is a view showing an example of density of an image formed on a sheet along an axial direction of the developing roller according to the second embodiment of the present disclosure.

FIG. 12 is a view showing an example of magnetic flux density distribution M_d_1 of the piece 841_1 along an axial direction of the developing roller 84 according to the second embodiment of the present disclosure. FIG. 13 is a view showing an example of density A of an image formed on a sheet along an axial direction of the developing roller 84 according to the second embodiment of the present disclosure. In image density A_1, with the amount of the total magnetic charge of the catch pole S1 kept constant, a position of the magnetic force peak is lowered, and the number of the magnetic force lines LMF is increased at the central part C wider than the width between the disk 825R and the disk 825L. Therefore, as shown in FIG. 13, the image density A_1 is uniform over the entire surface as compared with image density A_2 in a case where there is no difference in the magnetic flux density distribution M_d between the central part C and the non-central part NC.

From the above description, according to the present embodiment, a part of the magnetic flux density distribution M_d_1 appears from the central part C facing a region that is a boundary between the first circulation path and the second circulation path. Another part of the magnetic flux density distribution M_d_1 appears from the non-central part NC adjacent to the central part C. Therefore, while increasing the amount of the developer D conveyed from the central part C to the photoreceptor 413 via the developing roller 84, it is possible to keep the amount of the developer D conveyed to the photoreceptor 413 via the entire developing roller 84 constant. Therefore, while the developer D is uniformly conveyed to the entire electrostatic latent image formed on the photoreceptor 413, it is possible to uniformly convey the developer D to the electrostatic latent image formed on the photoreceptor 413 as a whole since it is possible to increase the amount of the developer D conveyed to an area where the conveying force becomes weak on a part of the electrostatic latent image formed on the photoreceptor 413.

Further, according to the present embodiment, the magnetic flux density in the central part C is stronger than the magnetic flux density in the non-central part NC. Therefore, even if the amount of the developer D present at an area that is the boundary between the supply screw 83R and the supply screw 83L is small, the developer D can be conveyed with the shortage compensated since the magnetic flux density in the central part C is stronger than time magnetic flux density in the non-central part NC.

Further, according to the present embodiment, the developing container 81 includes the partition plate 89 that faces the central part C, is provided at a boundary between the supply screw 83R and the supply screw 83L and between the stirring screw 82R and the stirring screw 82L, and partitions between the first circulation path and the second circulation path. Therefore, since the first circulation path and the second circulation path are adjacent to each other along the axial direction of the developing roller 84, it is possible to extend a conveyance range of the developer D that can be conveyed to the electrostatic latent image formed on the photoreceptor 413 along the axial direction of the developing roller 84, by supplying the developer D that can be supplied from the first circulation path and the developer D that can be supplied from the second circulation path to the developing roller 84. Therefore, it is possible to perform development corresponding to a wide sheet.

Further, according to the present embodiment, the central part C of the developing roller 84 is provided in a range wider than a width between the disk 835R and the disk 835L, along the axial direction of the developing roller 84. Therefore, although the number of the magnetic force lines LMF is increased along a circumferential direction of the developing roller 84 in a part of the magnetic flux density distribution M_d_1, a position of the magnetic force peak along the axial direction of the developing roller 84 is lower than that of another part of the magnetic flux density distribution M_d_1. Therefore, it is possible to uniformalize the density A of the image formed on the sheet while suppressing a flow of the developer D into between the disk 835R and the disk 835L.

Third Embodiment

Figure 14:
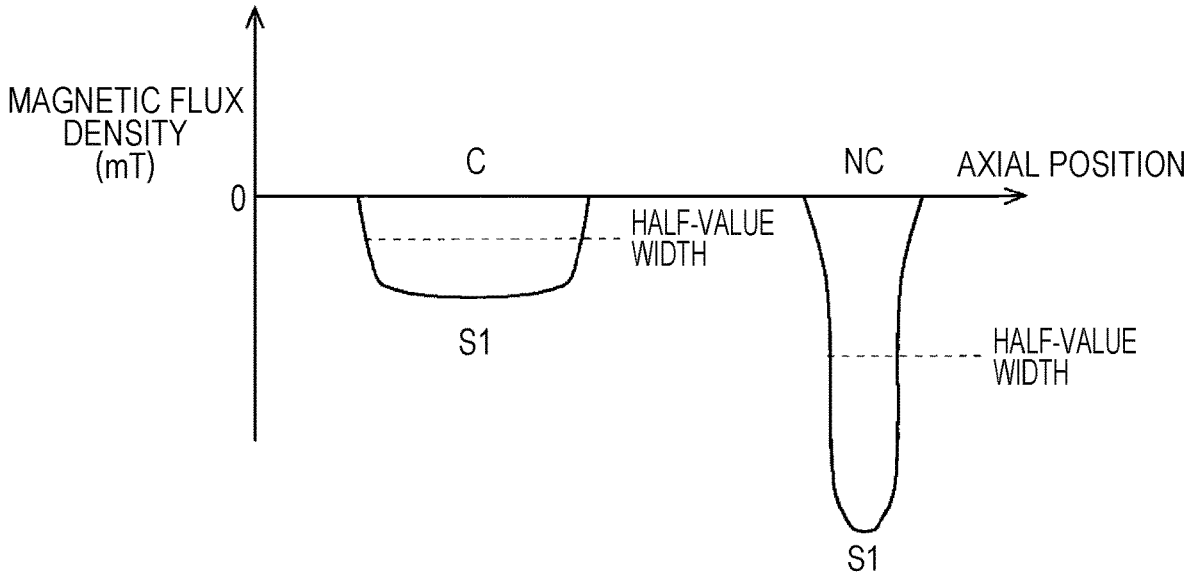
FIG. 14 is a characteristic view showing an example of magnetic flux density in a normal direction of a catch pole according to a third embodiment of the present disclosure.

In a third embodiment, the same components as those of the first and second embodiments are denoted by the same reference numerals, and description thereof is omitted. The third embodiment is based on the configuration of the first or second embodiment, and a half-value width of magnetic flux density at a central part C will be described. FIG. 14 is a characteristic view showing an example of magnetic flux density in a normal direction of a catch pole S1 according to the third embodiment of the present disclosure. The broken line shows magnetic flux density of the half-value width of the magnetic flux density in a normal direction of each catch pole S1 of the central part C and a non-central part NC. As shown in FIG. 14, in the catch pole S1, the half-value width of the magnetic flux density part C is wider than the half value width of the magnetic flux density at the non-central part NC.

From the above description, according to the present embodiment, in the catch pole S1, the half-value width of the magnetic flux density at the central part C is wider than the half value width of the magnetic flux density at the non-central part NC. This enables an increase in the number of magnetic force lines LMF in the central part C at an area with the half-value width, as compared with the non-central part NC. Therefore, as compared with the non-central part NC, the central part C can easily attract the developer D to the developing roller 84 at the area with the half-value width.

Fourth Embodiment

Figure 15:
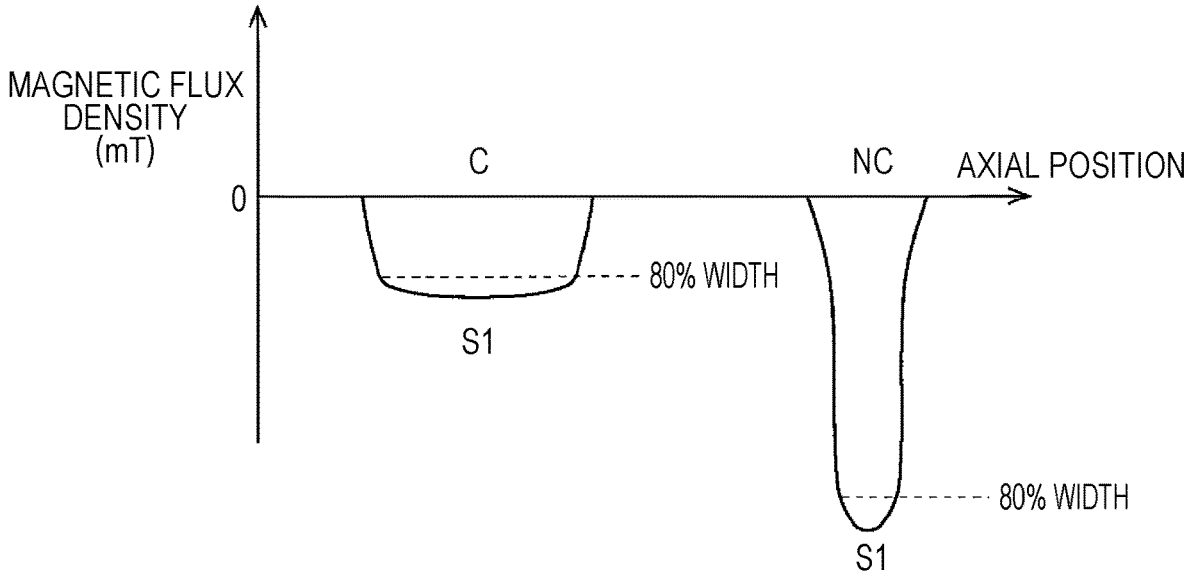
FIG. 15 is a characteristic view showing an example of magnetic flux density in a normal direction of a catch pole according to a fourth embodiment of the present disclosure.

In a fourth embodiment, the same components as those in the first to third embodiments are denoted by the same reference numerals, and description thereof is omitted. The fourth embodiment is based on the configuration of the first or second embodiment, and an 80% width of magnetic flux density at a central part C will be described, which is different from the third embodiment in which the half-value width of the magnetic flux density at the central part C is described. FIG. 15 is a characteristic view showing an example of magnetic flux density in a normal direction of a catch pole S1 according to the fourth embodiment of the present disclosure. The broken line shows magnetic flux density of the 80% width of the magnetic flux density in a normal direction of each catch pole S1 of the central part C and a non-central part NC. As shown in FIG. 5, in the catch pole S1, the 80% widths of the magnetic flux density at the central part C is wider than the 80% width of the magnetic flux density at the non-central part NC.

From the above description, according to the present embodiment, in the catch pole S1, the 80% width of the magnetic flux density at the central part C is wider than the 80% width of the magnetic flux density at the non-central part NC. This enables an increase in the number of magnetic force lines LMF in the central part C at an area with the 80% width, as compared with the non-central part NC. Therefore, as compared with the non-central part NC, the central part C can easily attract the developer D to the developing roller 84 at the area with 80% width.

Although the developing device 412 and the image forming apparatus 1 according to the present disclosure have been described based on the embodiments above, the present disclosure is not limited thereto, and modifications may be made without departing from the spirit of the present disclosure.

For example, in the present embodiment, the example in which seven magnetic poles are formed on the developing roller 84 has been described, but the present invention is not particularly limited thereto. For example, five magnetic poles may be formed on the developing roller 84. The developing roller 84 may be any as long as it conveys the developer D to the photoreceptor 413 with the magnetic brush appearing due to the formation of a plurality of magnetic poles.

Although embodiments of the present invention have been described and illustrated in detail, the disclosed embodiments are made for purposes of illustration and example only and not limitation. The scope of the present invention should be interpreted by terms of the appended claims.

What is claimed is:

1. A developing device for developing an electrostatic latent image formed on a photoreceptor with a developer to form an image, the developing device comprising:

a developing container that contains the developer; and a developing roller that faces the photoreceptor, is arranged adjacent to the developing container, and conveys the developer contained in the developing container to the photoreceptor, wherein the developing roller includes a magnetic pole forming part to be formed with a plurality of magnetic poles along a circumferential direction of the developing roller, at least a catch pole is formed as one of the plurality of magnetic poles, and the catch pole is the pole facing the developing container, and in the catch pole, an amount of a total magnetic charge in an axial direction of the developing roller is kept constant, and a part of magnetic flux density distribution is different from another part of magnetic flux density distribution along the axial direction of the developing roller.

2. The developing device according to claim 1, wherein the part of magnetic flux density distribution has a position of a magnetic force peak lower than that of the another part of magnetic flux density distribution.

3. The developing device according to claim 1, wherein the developing container is formed with:

a first circulation path; and a second circulation path adjacent to the first circulation path along the axial direction of the developing roller, the magnetic pole forming part includes:

along the axial direction of the developing roller, a central part facing a region that is a boundary between the first circulation path and the second circulation path; and a non-central part adjacent to the central part, the part of magnetic flux density distribution is formed to appear from the central part, and the another part of magnetic flux density distribution is formed to appear from the non-central part.

4. The developing device according to claim 3, wherein the developing container is provided with:

in the first circulation path, a first stirring screw that stirs the developer; and a first supply screw that supplies the developer stirred by the first stirring screw to the developing roller, between the developing roller and the first stirring screw, and in the second circulation path, a second stirring screw that stirs the developer; and a second supply screw that supplies the developer stirred by the second stirring screw to the developing roller, between the developing roller and the second stirring screw, the central part faces a region including an area that is a boundary between the first supply screw and the second supply screw, and magnetic flux density in the central part is stronger than magnetic flux density in the non-central part.

5. The developing device according to claim 4, wherein the developing container further includes a partition plate that faces the central part, is provided at a boundary between the first supply screw and the second supply screw and between the first stirring screw and the second stirring screw, and partitions between the first circulation path and the second circulation path.

6. The developing device according to claim 5, wherein the developing container further includes:

a first disk that is provided on a side close to the partition plate among ends of the first supply screw and suppresses a part of the developer from approaching the partition plate; and a second disk that is provided on a side close to the partition plate among ends of the second supply screw and suppresses a part of the developer from approaching the partition plate, and in the developing roller, the central part is provided in a range wider than a width between the first disk and the second disk along the axial direction of the developing roller.

7. An image forming apparatus comprising the developing device according to claim 1.

8. A developing device for developing an electrostatic latent image formed on a photoreceptor with a developer to form an image, the developing device comprising:

a developing container that contains the developer; and a developing roller that faces the photoreceptor, is arranged adjacent to the developing container, and conveys the developer contained in the developing container to the photoreceptor, wherein the developing roller includes a magnetic pole forming part to be formed with a plurality of magnetic poles along a circumferential direction of the developing roller, at least a catch pole is formed as one of the plurality of magnetic poles, and in the catch pole, an amount of a total magnetic charge in an axial direction of the developing roller is kept constant, and a part of magnetic flux density distribution is different from another part of magnetic flux density distribution along the axial direction of the developing roller, wherein in the catch pole, a half-value width of magnetic flux density in the part is wider than a half-value width of magnetic flux density in the another part.

9. A developing device for developing an electrostatic latent image formed on a photoreceptor with a developer to form an image, the developing device comprising:

a developing container that contains the developer; and a developing roller that faces the photoreceptor, is arranged adjacent to the developing container, and conveys the developer contained in the developing container to the photoreceptor, wherein the developing roller includes a magnetic pole forming part to be formed with a plurality of magnetic poles along a circumferential direction of the developing roller, at least a catch pole is formed as one of the plurality of magnetic poles, and in the catch pole, an amount of a total magnetic charge in an axial direction of the developing roller is kept constant, and a part of magnetic flux density distribution is different from another part of magnetic flux density distribution along the axial direction of the developing roller, wherein in the catch pole, an 80% width of magnetic flux density in the part is wider than an 80% width of magnetic flux density in the another part.

* * * * *